US008240402B2

(12) United States Patent
Rickabaugh et al.

(10) Patent No.: US 8,240,402 B2
(45) Date of Patent: Aug. 14, 2012

(54) EARTH-BORING TOOLS AND COMPONENTS THEREOF INCLUDING BLOCKAGE-RESISTANT INTERNAL FLUID PASSAGEWAYS, AND METHODS OF FORMING SUCH TOOLS AND COMPONENTS

(75) Inventors: David L. Rickabaugh, Spring, TX (US); Rudolf Carl Pessier, Spring, TX (US); Mark E. Anderson, The Woodlands, TX (US); William A. Moss, Conroe, TX (US); Redd H. Smith, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 322 days.

(21) Appl. No.: 12/570,852

(22) Filed: Sep. 30, 2009

(65) Prior Publication Data

US 2011/0073377 A1 Mar. 31, 2011

(51) Int. Cl.
*E21B 10/18* (2006.01)

(52) U.S. Cl. ..... 175/340; 175/393

(58) Field of Classification Search ..... 175/339, 175/340, 393

See application file for complete search history.

(56) References Cited

U.S. PATENT DOCUMENTS

| | | | | |
|---|---|---|---|---|
| 2,252,168 | A * | 8/1941 | Crcighton | 175/317 |
| 4,378,853 | A | 4/1983 | Chia et al. | |
| 4,793,426 | A * | 12/1988 | Millsapps, Jr. | 175/340 |
| 5,775,446 | A | 7/1998 | Lott | |
| 6,082,473 | A | 7/2000 | Dickey | |
| 6,098,728 | A * | 8/2000 | Wells et al. | 175/340 |
| 6,227,316 | B1 * | 5/2001 | Rohde | 175/340 |
| 6,390,211 | B1 | 5/2002 | Tibbitts | |
| 7,481,284 | B2 | 1/2009 | Wells et al. | |
| 2008/0236899 | A1 | 10/2008 | Oxford et al. | |
| 2010/0288563 | A1 * | 11/2010 | Smith | 175/393 |

FOREIGN PATENT DOCUMENTS

EP 0107630 A2 5/1984

OTHER PUBLICATIONS

International Search Report for International Application No. PCT/US2010/050744 mailed May 19, 2011, 3 pages.
International Written Opinion for International Application No. PCT/US2010/050744 mailed May 19, 2011, 3 pages.

* cited by examiner

*Primary Examiner* — William P Neuder
(74) *Attorney, Agent, or Firm* — TraskBritt

(57) ABSTRACT

Earth-boring drill bits include a bit body including a blockage-resistant internal fluid passageway. The blockage-resistant internal fluid passageway includes at least one internal fluid passageway formed in the bit body and a cuttings filtering feature formed in the at least one internal fluid passageway configured to prevent at least some cuttings from flowing through the at least one internal fluid passageway. In one embodiment, the cuttings filtering feature includes at least one lateral member extending transversely across the at least one internal fluid passageway. In another embodiment, the cuttings filtering feature includes forming a central portion of the at least one internal fluid passageway with a width along a lateral axis thereof less than an average width of a fluid path extending through a nozzle disposed at least partially within the at least one internal fluid passageway. Methods of forming the blockage-resistant internal fluid passageway are also disclosed.

18 Claims, 6 Drawing Sheets

EARTH-BORING TOOLS AND COMPONENTS THEREOF INCLUDING BLOCKAGE-RESISTANT INTERNAL FLUID PASSAGEWAYS, AND METHODS OF FORMING SUCH TOOLS AND COMPONENTS

TECHNICAL FIELD

Embodiments of the present invention relate generally to earth-boring drill bits and other tools that may be used to drill subterranean formations and to methods of manufacturing such drill bits and tools.

BACKGROUND

A typical fixed-cutter, or "drag," rotary drill bit for drilling subterranean formations includes a bit body having a face region thereon carrying cutting elements for cutting into an earth formation. The bit body may be secured to a hardened steel shank having a threaded pin connection for attaching the drill bit to a drill string that includes tubular pipe segments coupled end to end between the drill bit and other drilling equipment. Equipment such as a rotary table or top drive may be used for rotating the tubular pipe and drill bit. Alternatively, the shank may be coupled directly to the drive shaft of a down-hole motor to rotate the drill bit.

Typically, the bit body of a drill bit is formed from steel or a combination of a steel blank embedded in a matrix material that includes hard particulate material, such as tungsten carbide, infiltrated with a binder material, such as a copper alloy. A steel shank may be secured to the bit body after the bit body has been formed. Structural features may be provided at selected locations on and in the bit body to facilitate the drilling process. Such structural features may include, for example, radially and longitudinally extending blades, cutting element pockets, ridges, lands, and drilling fluid courses and passages. The cutting elements generally are secured within pockets that are formed into blades located on the face region of the bit body, either by machining if the bit body is steel or other machinable materials, or during the formation of the bit body of a matrix-type bit using displacements sized and configured to provide the pockets.

FIG. 1 illustrates a conventional fixed-cutter rotary drill bit 100 generally according to the description above. The rotary drill bit 100 includes a bit body 102 that is secured to a steel shank 112. The bit body 102 includes a crown 108 and a steel blank 110 that is embedded in the crown 108. The crown 108 includes a particle-matrix composite material such as, for example, particles of tungsten carbide embedded in a copper alloy matrix material. The bit body 102 is secured to the steel shank 112 by way of a threaded connection 114 and a weld 116 that extends around the drill bit 100 on an exterior surface thereof along an interface between the bit body 102 and the steel shank 112. The steel shank 112 includes an API threaded pin 118 for attaching the drill bit 100 to a drill string (not shown).

The bit body 102 includes wings or blades 120, which are separated by junk slots 122. Internal fluid passageways 105 extend between the face 124 of the bit body 102 and internal fluid plenum 126, which extends through the steel shank 112 and partially through the bit body 102. Nozzle inserts 136 may be provided at face 124 of the bit body 102 within the internal fluid passageways 105.

A plurality of polycrystalline diamond compact (PDC) cutters 128 is provided on the face 124 of the bit body 102. The PDC cutters 128 may be provided along the blades 120 within pockets 130 formed in the face 124 of the bit body 102, and may be supported from behind by buttresses 132, which may be integrally formed with the crown 108 of the bit body 102.

During drilling operations, the drill bit 100 is positioned at the bottom of a well borehole and rotated while drilling fluid, or "mud," is pumped to the face 124 of the bit body 102 through the internal fluid plenum 126 and the internal fluid passageways 105. The drilling fluid cools and cleans the PDC cutters 128 on face 124 of the bit body 102 and flushes debris removed by the drill bit 100 from the subterranean formation being drilled from the face 124 of the bit body 102 and up the wellbore annulus. Throughout the drilling process, the pumping of the drilling fluid may be periodically stopped, such as when additional drill pipe is added to the drill string. Drilling fluid in the wellbore annulus outside the drill string includes formation cuttings resulting from the drilling process and, thus, may be relatively denser than the drilling fluid within the drill string. As a result, when the pumping of the drilling fluid halts, drilling fluid, cuttings, and debris in the wellbore annulus may flow in reverse back into the internal fluid passageways 105 and the internal fluid plenum 126. This phenomenon is often referred to in the art as the "U-tube effect." Large cuttings and debris that enter the internal fluid passageways 105 due to the U-tube effect may accumulate and become trapped in the internal fluid passageways 105 or the internal fluid plenum 126. As a result, when the pumping of the drilling fluid is restarted, some or all of the internal fluid passageways 105, as well as the internal fluid plenum 126, may become blocked or clogged. Consequently, time and money must be expended to unblock the internal fluid passageways 105 and the internal fluid plenum 126 so that the drilling fluid may adequately flow through the internal fluid passageways 105 and the internal fluid plenum 126 for efficient drilling.

BRIEF SUMMARY

In one embodiment, the present invention includes an earth-boring rotary drill bit comprising a bit body having at least one internal fluid passageway extending therethrough and at least one lateral member extending transversely across the at least one internal fluid passageway. The at least one lateral member may be coupled to a surface of the bit body within the at least one internal fluid passageway, a nozzle disposed at least partially within the at least one internal fluid passageway, or a washer. If the at least one lateral member is coupled to a washer, the washer may be disposed between an annular surface of the bit body within the at least one internal fluid passageway and a nozzle at least partially disposed within the at least one internal fluid passageway. In some embodiments, the at least one lateral member may further comprise a longitudinal member extending perpendicularly therefrom in a direction generally parallel to a direction of intended fluid flow through the at least one internal fluid passageway. In additional embodiments, the at least one lateral member may comprise intersecting lateral members.

In additional embodiments, the present invention includes methods of forming an earth-boring rotary drill bit comprising a bit body having at least one internal fluid passageway extending therethrough and at least one lateral member extending transversely across the at least one internal fluid passageway. The methods include forming at least one lateral member extending across a washer, disposing the washer in the at least one internal fluid passageway, inserting a nozzle at least partially within the at least one internal fluid passageway, and configuring the surface of the bit body within the at least one internal fluid passageway and the nozzle to provide mechanical interference between the washer, the surface of the bit body within the at least one internal fluid passageway and the nozzle to retain the washer in the at least one internal fluid passageway. In another embodiment, at least two holes are formed in opposing sides of a nozzle and ends of the at least one lateral member are positioned at least partially within the at least two holes so that the at least one lateral member extends across the nozzle. The nozzle is at least partially secured within the at least one internal fluid passageway. In another embodiment, the at least one lateral member may be formed while making the bit body by using a displacement having the at least one lateral member therein or by a hole in the displacement for the at least one lateral member to be integrally formed with the bit body.

In yet additional embodiments, the present invention includes an earth-boring drill bit comprising a bit body having at least one internal fluid passageway formed therein, and a nozzle disposed at least partially within the at least one internal fluid passageway wherein a central portion of the at least one internal fluid passageway has a width along a lateral axis thereof less than an average width of a fluid path extending through the nozzle. The central portion of the at least one internal fluid passageway may also include a second lateral axis having a width greater than the average width of the fluid path extending through the nozzle.

In yet additional embodiments, the present invention includes methods of forming an earth-boring rotary drill bit having at least one internal fluid passageway formed therein wherein a central portion of the at least one internal fluid passageway has a width along a lateral axis thereof less than a width of an exterior portion of the at least one internal fluid passageway.

BRIEF DESCRIPTION OF THE SEVERAL VIEWS OF THE DRAWINGS

While the specification concludes with claims particularly pointing out and distinctly claiming what are regarded as embodiments of the present invention, the advantages of embodiments of the present invention may be more readily ascertained from the following description of embodiments of the invention when read in conjunction with the accompanying drawings in which:

DETAILED DESCRIPTION

The illustrations presented herein are not meant to be actual views of any particular drill bit, nozzle, fluid passageway, or other component of a drill bit, but are merely idealized representations used to describe embodiments of the present invention. Additionally, elements common between figures may retain the same numerical designation.

Figure 1:
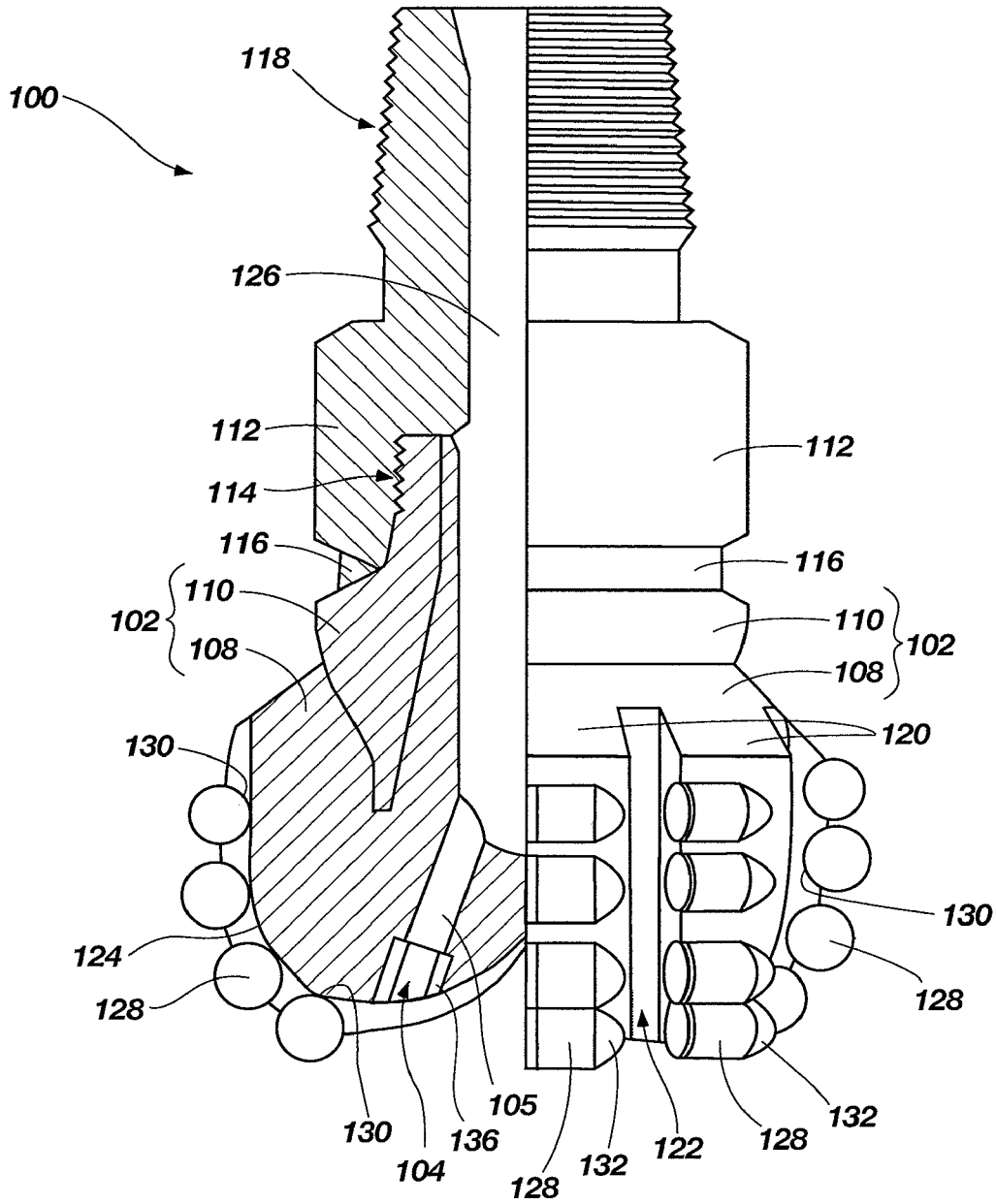
FIG. 1 (PRIOR ART)
FIG. 1 is a partial longitudinal cross-sectional view of a conventional earth-boring rotary drill bit having an internal fluid plenum and internal fluid passageways.
Figure 2:
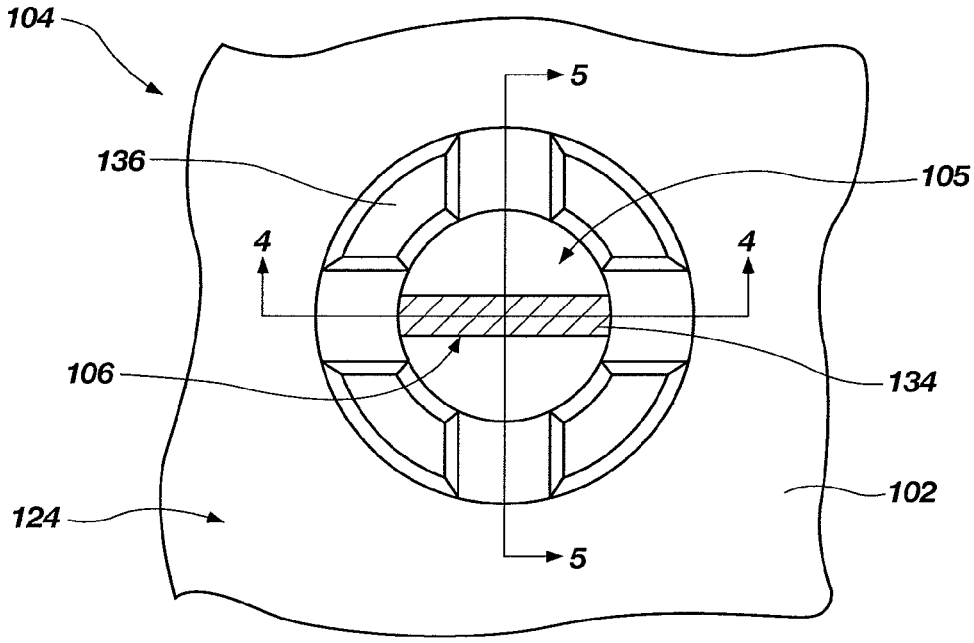
FIG. 2 is a plan view of one embodiment of a blockage-resistant internal fluid passageway of the present invention viewed from a face of an earth-boring drill bit in which it is disposed.
Figure 3:
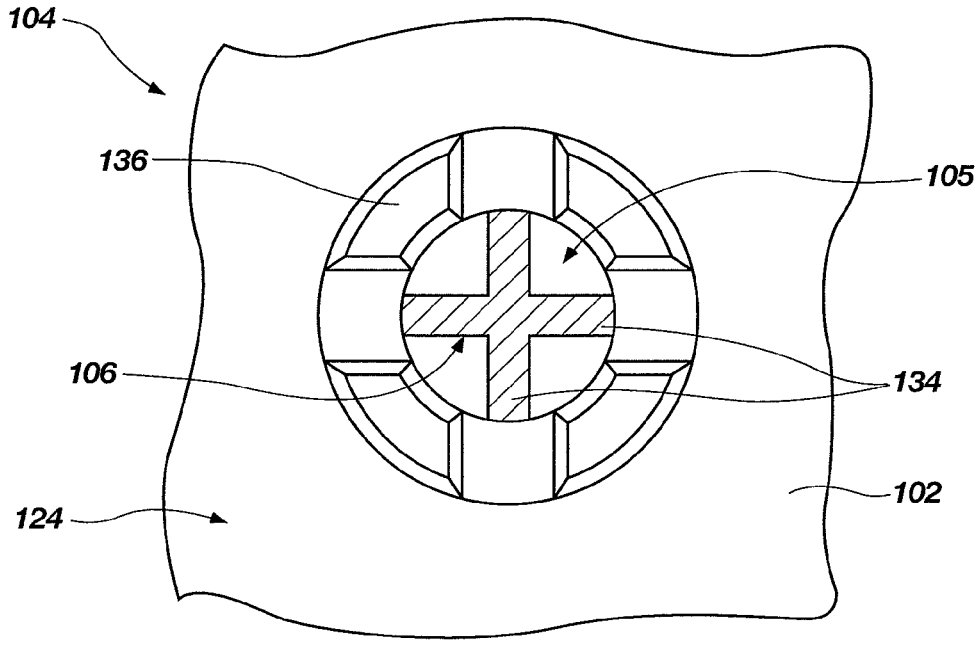
FIG. 3 is a plan view of another embodiment of a blockage-resistant internal fluid passageway of the present invention viewed from the face of an earth-boring drill bit in which it is disposed.

FIG. 2 is an enlarged plan view of one embodiment of a blockage-resistant internal fluid passageway 104 of the present invention viewed from a face 124 of a bit body 102 of an earth-boring drill bit, which may, by way of non-limiting example, be similar to the drill bit 100 shown and described with reference to FIG. 1. The blockage-resistant internal fluid passageway 104 includes a filtering feature 106 disposed within an internal fluid passageway 105. The filtering feature 106 includes at least one lateral member 134 that is disposed within the internal fluid passageway 105 and extends laterally across the internal fluid passageway 105 generally transverse to the direction of fluid flow through the internal fluid passageway 105. A nozzle 136 may also be disposed at least partially within the internal fluid passageway 105, as discussed in further detail below. The at least one lateral member 134 may extend along a diameter of the internal fluid passageway 105. In another embodiment, as shown in FIG. 3, the filtering feature 106 may include at least two lateral members 134 that intersect in a center of the internal fluid passageway 105.

Figure 4:
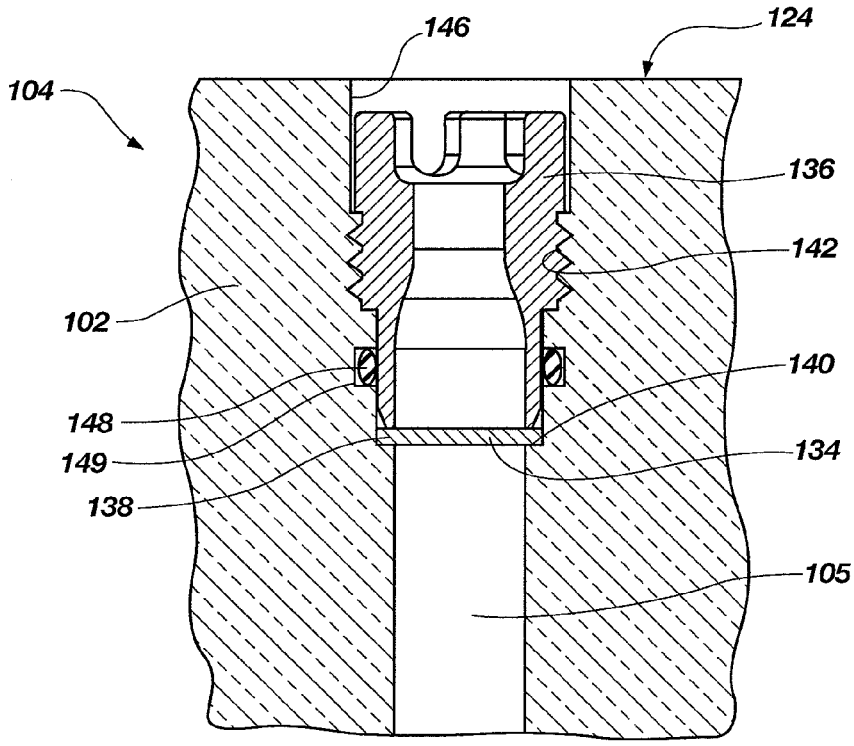
FIG. 4 is a longitudinal cross-sectional view of the blockage-resistant internal fluid passageway of FIG. 2 taken along section line 4-4 shown therein.
Figure 5:
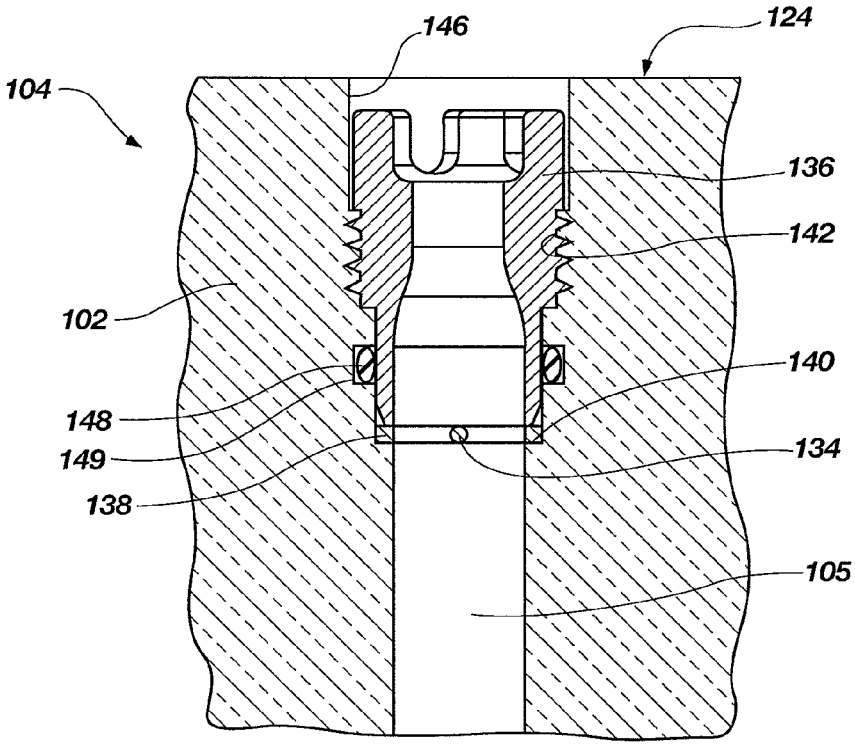
FIG. 5 is a longitudinal cross-sectional view of the blockage-resistant internal fluid passageway of FIG. 2 taken along section line 5-5 shown therein.

FIG. 4 is an enlarged longitudinal cross-sectional view of the blockage-resistant internal passageway 104 of FIG. 2 taken along section line 4-4 in FIG. 2. FIG. 5 is an enlarged longitudinal cross-sectional view of the blockage-resistant internal passageway 104 of FIG. 2 taken along section line 5-5 in FIG. 2. The at least one lateral member 134 may be coupled to, or an integral part of, a washer 138 that fits onto and is supported by an annular shoulder 140 formed in a surface 146 of the bit body 102 within the internal fluid passageway 105. The nozzle 136 may be secured within the internal fluid passageway 105 by threads, which engage mating threads 142 on the surface 146 of the bit body 102 within the internal fluid passageway 105. While the nozzle 136 is illustrated in FIG. 4 as being secured within the internal fluid passageway 105 by threads 142, other retention mechanisms, such as, for example, retaining rings, threaded jam-nuts, adhesives, and brazes, may be used to secure the nozzle 136 within the internal fluid passageway 105. The outer surface or wall of the nozzle 136 may be in sealing contact with a compressed O-ring 148 disposed in an annular groove 149 formed in the surface 146 of the bit body 102 within the internal fluid passageway 105 to provide a fluid seal between the bit body 102 and the nozzle 136. The washer 138, and, hence, the at least one lateral member 134 coupled thereto, is retained in the internal fluid passageway 105 by configuring the surface 146 of the bit body 102 within the internal fluid passageway 105 and the nozzle 136 to provide mechanical interference between the washer 138, the surface 146 of the bit body 102 within the internal fluid passageway 105, and the nozzle 136. For example, the washer 138 may be positioned between the annular shoulder 140 and the interior end of the nozzle 136. In some embodiments, a nozzle inlet tube (not shown) may also be located within the internal fluid passageway 105. In such embodiments, the washer 138 may be retained in the internal fluid passageway 105 by placement between the nozzle 136 and the nozzle inlet tube. The nozzle 136 and the washer 138 may be replaceable and may be replaced should the drilling fluid erode or wear the parts within the internal fluid passageway 105 extending through these components, when a nozzle 136 having a different orifice size is desired, or when a different shape or size of the at least one lateral member 134 is desired.

The at least one lateral member 134 and the washer 138 may comprise a metal alloy, such as a steel, a particle-matrix composite, such as cobalt-cemented tungsten carbide, or a combination thereof. Further, if the at least one lateral member 134 comprises a steel or other relatively tough and ductile but erosion-prone material, a hardfacing may be applied thereto for enhanced resistance to erosion by drilling fluid. The material of the at least one lateral member 134 may be strong enough to prevent ingress of large cuttings and debris into the internal fluid passageway 105 and/or to disintegrate or split relatively larger cuttings as they are forced past the at least one lateral member 134 by the flow of drilling fluid. The washer 138 and the at least one lateral member 134 may be formed by any method known, such as, for example, machining processes, casting processes, molding processes (e.g., injection molding), or pressing and sintering processes. The at least one lateral member 134 may be integrally formed with the washer 138, or the at least one lateral member 134 may be formed independently from the washer 138 and subsequently attached to the washer 138 (e.g., by welding the at least one lateral member 134 to the washer 138). Additionally, the at least one lateral member 134 may be held in place with washer 138 by mechanical compression between the interior end of nozzle insert 136 and annual shoulder 140.

Because the at least one lateral member 134 extends across the internal fluid passageway 105, cuttings and debris that are larger than about half, or slightly less than half, in cross-section transverse to internal fluid passageway 105, of the diameter of the internal fluid passageway 105 will be unable to enter into the internal fluid passageway 105 and the internal fluid plenum 126 (FIG. 1) when the pumping of the drilling fluid is halted. The large cuttings and debris will either be blocked at the at least one lateral member 134 or broken into two or more smaller pieces having a size small enough to pass around the at least one lateral member 134. When the pumping of the drilling fluid is restarted, any large cuttings and debris blocked by the at least one lateral member 134 will be flushed out the internal fluid passageway 105. Pumping of the drilling fluid may remain substantially unaffected by the at least one lateral member 134, as the reduction in cross-sectional area of the internal fluid passageway 105 available for fluid flow caused by the at least one lateral member 134 may be insignificant as a practical matter. The diameter of the internal fluid passageway 105 may also be slightly increased when the bit is designed and fabricated to compensate for any reduction in cross-sectional area of the internal fluid passageway 105 available for fluid flow caused by the presence of the at least one lateral member 134.

Figure 6:
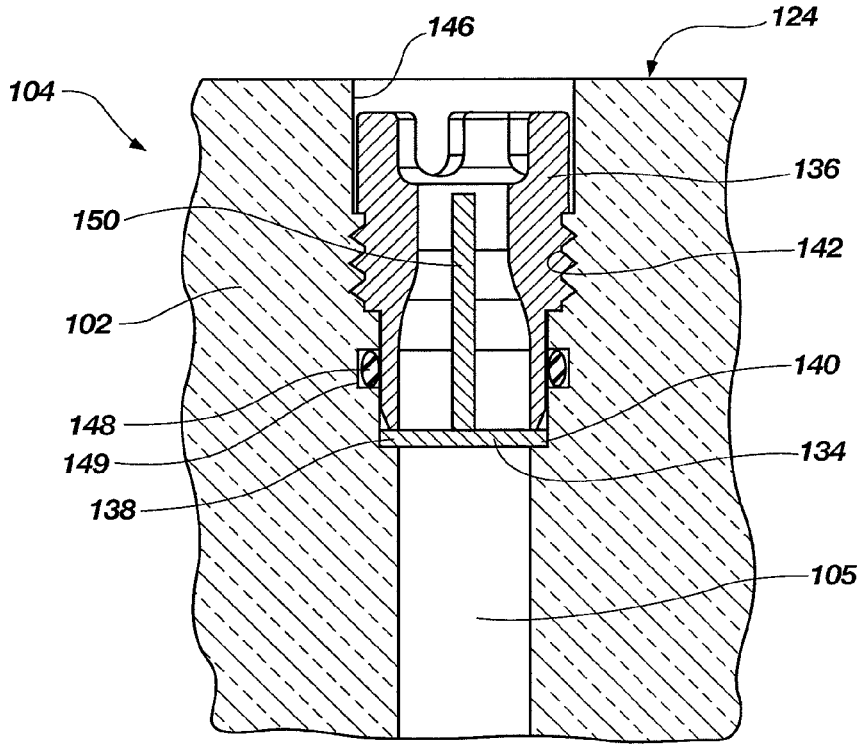
FIG. 6 is a longitudinal cross-sectional view of another embodiment of a blockage-resistant internal fluid passageway of the present invention.
Figure 7:
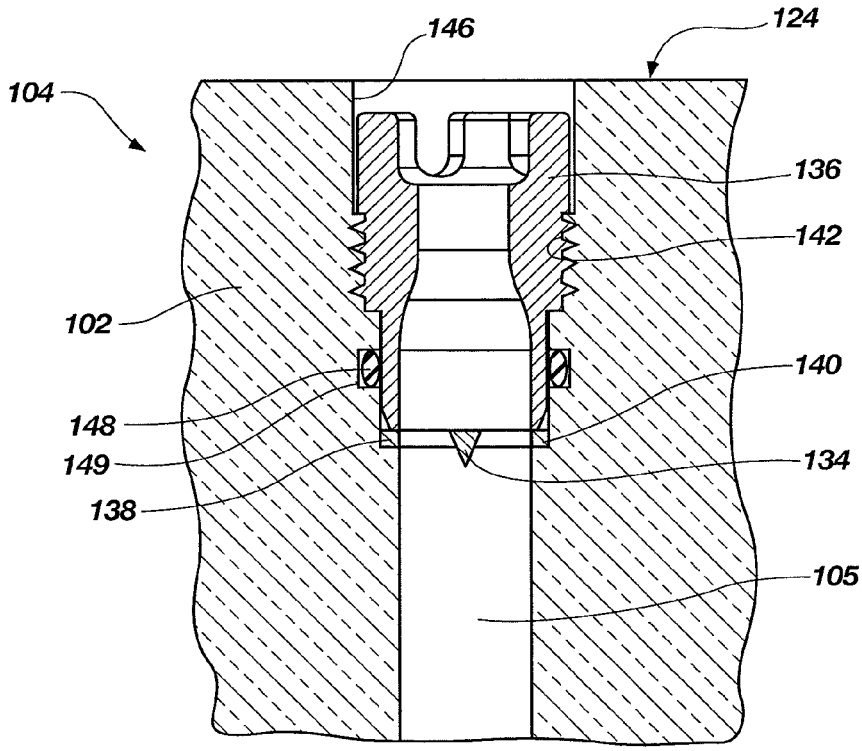
FIG. 7 is a longitudinal cross-sectional view of another embodiment of a blockage-resistant internal fluid passageway of the present invention.

As illustrated in FIG. 6, in some embodiments, a longitudinal member 150 that extends perpendicularly from the at least one lateral member 134 may be coupled to or integrally formed with, the at least one lateral member 134. The longitudinal member 150 extends through the nozzle 136 toward the face 124 of the bit body 102. The longitudinal member 150 may further hinder entry of large cuttings and debris into the internal fluid passageway 105 and also assist in breaking down large cuttings and debris into smaller pieces. As illustrated in FIG. 7, the at least one lateral member 134 may be shaped to reduce the resistance to fluid flow through the internal fluid passageway 105 during drilling operations caused by the at least one lateral member 134 (which may facilitate maintenance of a less turbulent fluid flow within the internal fluid passageway 105). For example, at least the inner side of the at least one lateral member 134 may be shaped to have an edge or a peak, with angled or tapered side surfaces extending away from the edge or peak in the direction of fluid flow through the internal fluid passageway during drilling. Such a configuration may serve to divert the flow of the drilling fluid around the at least one lateral member 134 and reduce friction of the drilling fluid against the at least one lateral member 134.

Figure 8:
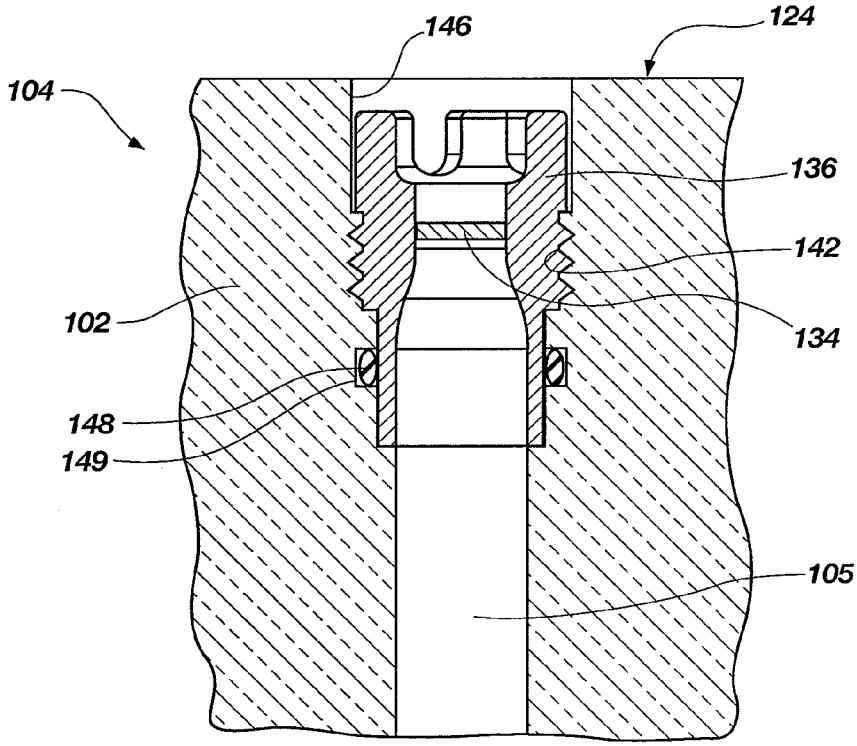
FIG. 8 is a longitudinal cross-sectional view of another embodiment of a blockage-resistant internal fluid passageway of the present invention.

As illustrated in FIG. 8, in another embodiment of the present invention, the at least one lateral member 134 may be disposed within the nozzle 136. The at least one lateral member 134 may be integrally formed with the nozzle 136 in some embodiments. In additional embodiments, the at least one lateral member 134 may be attached to the nozzle 136. For example, holes may be drilled through opposing sides of the nozzle 136 using, for example, an electric discharge machining (EDM) process. The at least one lateral member 134 may then be inserted through the holes to position the ends of the at least one lateral member 134 within the holes. Optionally, an adhesive, such as, for example, epoxy, or a braze or weld may be used to secure the at least one lateral member 134 within the nozzle 136.

Figure 9:
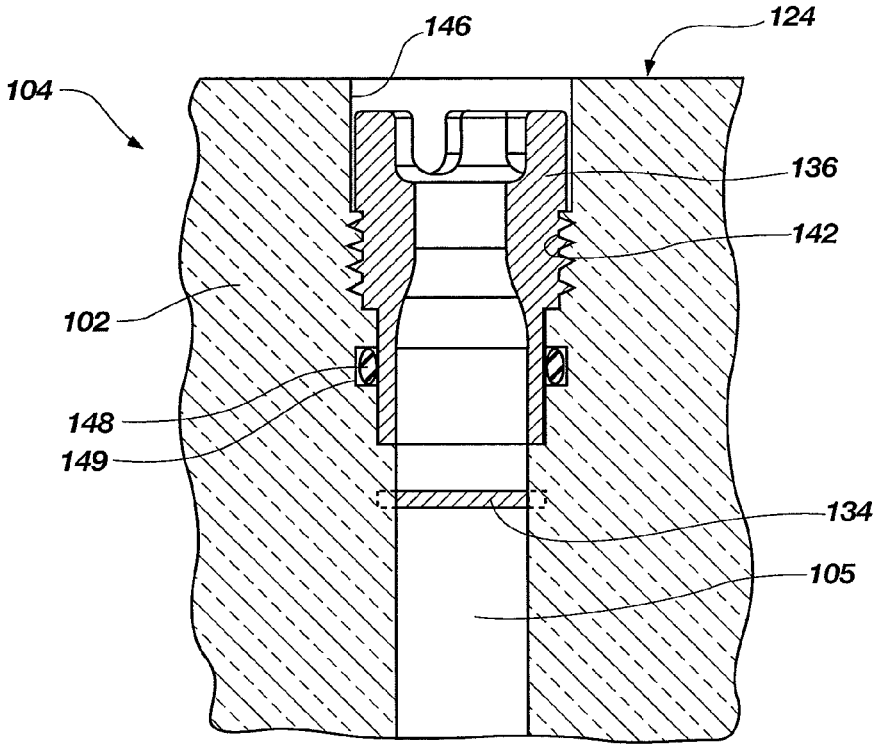
FIG. 9 is a longitudinal cross-sectional view of another embodiment of a blockage-resistant internal fluid passageway of the present invention.

In yet another embodiment, the at least one lateral member 134 may be foamed or otherwise disposed in the bit body 102 during fabrication thereof as illustrated in FIG. 9. The bit body 102 may comprise a particle-matrix composite material and may be formed using conventional infiltration techniques within a mold. In such an infiltration technique, a cavity is formed in a mold comprising a refractory material (e.g., graphite). The cavity may be formed in the mold using machining processes (e.g., milling, drilling, and grinding processes using multi-axis machining systems). Fine features may be added to the cavity of the graphite mold using hand-held tools. Additional clay work also may be required to obtain the desired configuration of some features of the bit body 102. Preform elements or displacements (which may comprise ceramic components, graphite components, or resin-coated sand compact components) may be positioned within the mold and used to define the blockage-resistant internal fluid passageways 104, cutting element pockets 130, junk slots 122 (FIG.1), and other external topographic features of the bit body 102.

In some embodiments, the at least one lateral member 134 may be placed within one of the displacements used to define the internal fluid passageway 105, such that each end of the at least one lateral member 134 extends beyond the sides of the displacement into an area of the cavity of the mold in which the bit body 102 is to be formed.

The cavity of the graphite mold is filled with hard particulate carbide material (such as tungsten carbide, titanium carbide, tantalum carbide, etc.). The preformed steel blank 110 (FIG. 1) may then be positioned in the mold at the appropriate location and orientation. The steel blank 110 typically is at least partially submerged in the particulate carbide material within the mold. A matrix material (often referred to as a "binder" material), such as a copper-based alloy, may be melted and caused or allowed to infiltrate the particulate carbide material within the mold cavity. The mold and bit body 102 are allowed to cool to solidify the matrix material. The steel blank 110 is bonded to the particle-matrix composite material forming the crown 108 (FIG.1) upon cooling of the bit body 102 and solidification of the matrix material.

In some embodiments, the displacement used to define the internal fluid passageway 105 may include an opening extending therethough, and the opening may, optionally, be prefilled with particulate carbide material the same or similar to that which is also used to fill the mold cavity prior to the infiltration process. Thus, when a molten matrix material is allowed to infiltrate the particulate carbide material within the mold cavity (and, optionally, within the opening extending through the displacement used to define the internal fluid passageway 105), the metal matrix material will enter into the opening extending through the displacement used to define the internal fluid passageway 105.

After infiltration, and upon cooling and solidification of the metal matrix material, the at least one lateral member 134 may be formed within the displacement used to define the internal fluid passageway 105.

Once the bit body 102 has cooled, the bit body 102 is removed from the mold and any displacements are removed from the bit body 102, such as the displacement foaming the internal fluid passageway 105. When the displacement is removed from internal fluid passageway 105, the at least one lateral member 134 remains in internal fluid passageway 105 bonded to, or integrally formed with, the bit body 102.

In additional embodiments, the bit body 102 may be formed using so-called particle compaction and sintering techniques. A powder mixture comprising hard particles and particles of matrix material may be pressed (e.g., with substantially isostatic pressure) within a mold or container to form a green bit body, which then may be sintered to a desired final density to form the bit body 102. Certain structural features may be machined in the green body using conventional machining techniques including, for example, turning techniques, milling techniques, and drilling techniques. By way of example and not limitation, blades 120 (FIG. 1) and other features may be machined or otherwise formed in the green body. The green body may be at least partially sintered to provide a brown (partially sintered) body which has less than a desired final density. The brown body may be machinable due to the remaining porosity therein. Certain structural features also may be machined in the brown body using conventional machining techniques. By way of example and not limitation, internal fluid passageways 105, cutting element pockets 130, and buttresses 132 (FIG. 1) may be machined or otherwise formed in the brown body. The brown body then may be fully sintered to a desired final density to form the bit body 102.

In some embodiments, at least one pre-formed lateral member 134 may be placed within a green or brown bit body 102 prior to sintering the bit body 102 to a desired final density, and the at least one lateral member 134 may bond to the bit body 102 during the sintering process.

In additional embodiments, an internal fluid passageway 105 may be formed in a green or brown bit body using a machining process, and not all of the material of the green or brown bit body may be removed from within the fluid passageway so as to define at least one lateral member 134 within the internal fluid passageway 105 in the green or brown bit body. The green or brown bit body (and the at least one lateral member 134 within the internal fluid passageway 105 therein) then may be sintered to a desired final density, including the at least one lateral member 134.

Figure 10:
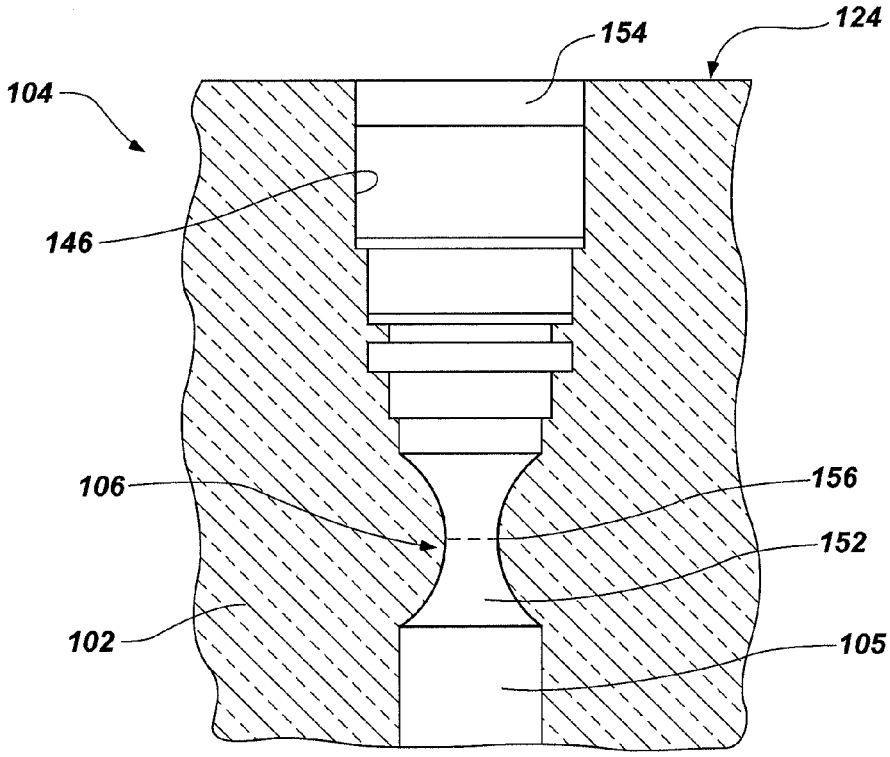
FIGS. 10 and 11 are longitudinal cross-sectional views of another embodiment of a blockage-resistant internal fluid passageway of the present invention.
Figure 11:
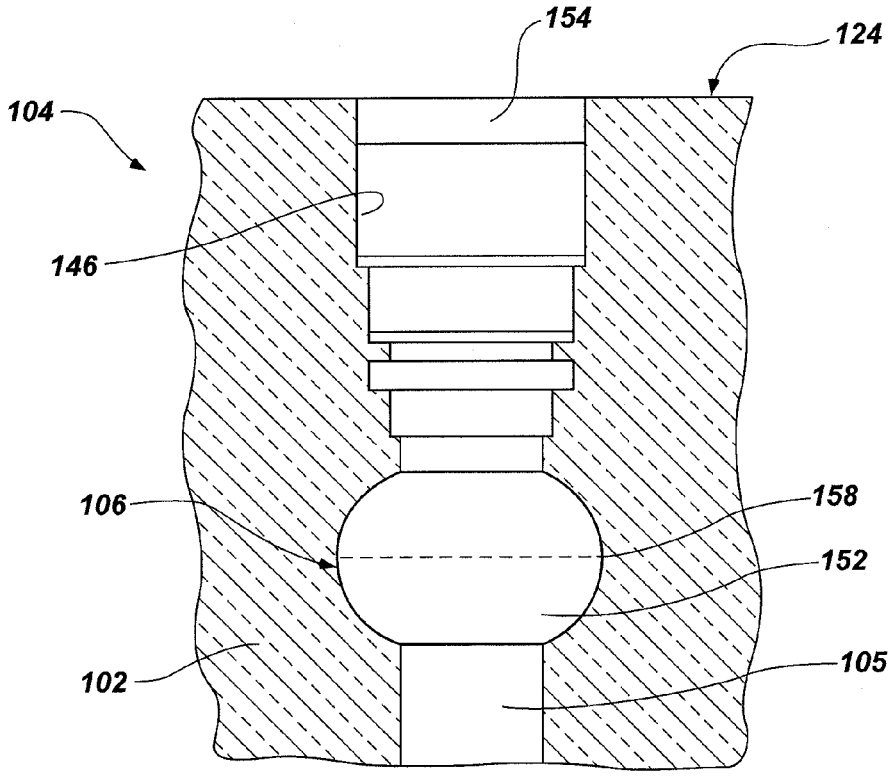

Another embodiment of a blockage-resistant internal fluid passageway 104 of the present invention for use in a drill bit 100 (FIG. 1) is shown in enlarged longitudinal cross-sectional views in FIGS. 10 and 11. The view of FIG. 11 is taken perpendicular to the view shown in FIG. 10, looking into the drawing sheet. As previously discussed, the blockage-resistant internal fluid passageway 104 includes a filtering feature 106 disposed within an internal fluid passageway 105 formed in a bit body 102. The internal fluid passageway 105 has a longitudinal central portion 152 and a longitudinal exterior portion 154. The exterior portion 154 of the internal fluid passageway 105 may be configured to receive a nozzle 136, as previously discussed in relation to FIGS. 2, 4, and 5. The central portion 152 of the internal fluid passageway 105 may be formed to have a generally elliptical cross-sectional shape having a minor first lateral axis 156 as shown by dashed lines in FIG. 10 and a major second lateral axis 158 as shown by dashed lines in FIG. 11. The first lateral axis 156 of the central portion 152 has a width less than an average diameter of a fluid passageway extending through a nozzle to be secured within the exterior portion 154. The second lateral axis 158 of the central portion 152 may have a width greater than the average diameter of a fluid passageway extending through a nozzle to be secured within the exterior portion 154.

In this configuration, large cuttings and debris that pass through a nozzle secured within the exterior portion 154 of the internal fluid passageway 105 that are larger than the width of the central portion 152 of the internal fluid passageway 105 will be unable to pass through the central portion 152 and, thus, will be unable to enter the fluid plenum 126 (FIG. 1) when the pumping of the drilling fluid through the internal fluid passageway 105 is halted. The large cuttings and debris will either be blocked at the central portion 152 of the internal fluid passageway 105 or broken down into smaller pieces capable of passing through the central portion 152. When the pumping of the drilling fluid is restarted, any large cuttings and debris blocked at the central portion 152 will be flushed out from the internal fluid passageway 105. Pumping of the drilling fluid may be relatively unaffected by the presence of the central portion 152, as the transverse cross-sectional area of the internal fluid passageway 105 may be generally constant through the internal fluid passageway 105, including through the central portion 152, or may increase through the internal fluid passageway 105 (and the central portion 152).

The blockage-resistant internal fluid passageway 104 shown in FIGS. 10 and 11 may be formed, for example, by using a perform element or displacement having a shape corresponding to the shape of the internal fluid passageway 105 shown in FIGS. 10 and 11 when forming the bit body 102 using an infiltration process, as discussed hereinabove. In additional embodiments, such an internal fluid passageway 105 may be formed (e.g., machined) in a green or brown bit body, and the green or brown bit body may be sintered to a desired final density, as also discussed hereinabove.

While embodiments of the present invention are described herein in relation to embodiments of earth-boring rotary drill bits that include fixed cutters and to embodiments of methods for forming such drill bits, the present invention also encompasses other types of earth-boring tools that include fluid passageways therein for directing fluid flow therethrough, such as, for example, core bits, eccentric bits, bicenter bits, reamers, mills, and roller cone bits, as well as methods for forming such tools. Thus, as employed herein, the term "drill bit" includes any earth-boring tool and the term "bit body" includes and encompasses bodies of all of the foregoing structures, as well as components and subcomponents of such structures.

While the present invention has been described herein with respect to certain embodiments, those of ordinary skill in the art will recognize and appreciate that it is not so limited. Rather, many additions, deletions and modifications to the described embodiments may be made without departing from the scope of the invention as hereinafter claimed, including legal equivalents. In addition, features from one embodiment may be combined with features of another embodiment while still being encompassed within the scope of the invention as contemplated by the inventors.

What is claimed is:

1. An earth-boring drill bit comprising:

a bit body having at least one internal fluid passageway extending therethrough;

at least one lateral member extending transversely across the at least one internal fluid passageway; and a longitudinal member extending perpendicularly from the at least one lateral member in a direction generally parallel to a direction of intended fluid flow through the at least one internal fluid passageway.

2. The earth-boring drill bit of claim 1, wherein the at least one lateral member comprises a particle-matrix composite material.

3. The earth-boring drill bit of claim 1, wherein the at least one lateral member comprises at least one edge.

4. An earth-boring drill bit comprising:

a bit body having at least one internal fluid passageway extending therethrough; and at least one lateral member extending transversely across the at least one internal fluid passageway, the at least one lateral member comprising at least two intersecting lateral members.

5. An earth-boring drill bit comprising:

a bit body having at least one internal fluid passageway extending therethrough; and at least one lateral member extending transversely across the at least one internal fluid passageway, the at least one lateral member being disposed at least partially inside a nozzle in the at least one internal fluid passageway.

6. An earth-boring drill bit comprising:

a bit body having at least one internal fluid passageway extending therethrough; and at least one lateral member extending transversely across the at least one internal fluid passageway, the at least one lateral member extending transversely across the at least one internal fluid passageway comprising a lateral member extending across a washer, the washer being disposed in the at least one internal fluid passageway between an annular surface of the bit body in the at least one internal fluid passageway and a nozzle at least partially disposed in the at least one internal fluid passageway.

7. An earth-boring drill bit comprising:

a bit body having at least one internal fluid passageway formed therein; and a nozzle disposed at least partially within the at least one internal fluid passageway;

wherein a central portion of the at least one internal fluid passageway has a width along a first lateral axis thereof less than an average width of a fluid path extending through the nozzle.

8. The earth-boring drill bit of claim 7, wherein the central portion of the at least one internal fluid passageway comprises a second lateral axis having a width greater than the average width of the fluid path extending through the nozzle.

9. The earth-boring drill bit of claim 8, wherein the central portion of the at least one internal fluid passageway has an elliptical cross-sectional shape.

10. The earth-boring drill bit of claim 7, wherein the bit body is at least substantially comprised of a particle-matrix composite material.

11. A method of forming an earth-boring drill bit, the method comprising:

forming at least one internal fluid passageway in a bit body of an earth-boring drill bit; and forming at least one filter feature in the at least one internal fluid passageway configured to prevent at least some cuttings from flowing through the at least one internal fluid passageway, wherein forming at least one filter feature in the at least one internal fluid passageway comprises:

forming at least two holes in opposing sides of a nozzle;

positioning ends of at least one lateral member into the at least two holes in the nozzle so that the at least one lateral member extends across the nozzle; and securing the nozzle at least partially within the at least one internal fluid passageway.

12. The method of claim 11, further comprising:

providing the at least one filter feature in a displacement having a shape corresponding to the at least one internal fluid passageway;

placing the displacement within a mold cavity having a shape corresponding to at least a portion of the bit body;

placing a plurality of hard particles within the mold cavity and surrounding the displacement with the at least one filter feature therein;

infiltrating the plurality of hard particles with a molten metal material;

solidifying the molten metal material to form a solid metal matrix material and bond the solid metal matrix material to the at least one filter feature; and removing the displacement from the bit body and leaving the at least one filter feature in the at least one internal fluid passageway.

13. The method of claim 11, wherein forming the at least one internal fluid passageway in the bit body of the earth-boring drill bit comprises:

forming a hole extending through a displacement having a shape corresponding to the at least one internal fluid passageway;

placing the displacement within a mold cavity having a shape corresponding to at least a portion of the bit body;

placing a plurality of hard particles within the mold cavity, around the displacement, and within the hole extending through the displacement;

infiltrating the plurality of hard particles with a molten metal material;

solidifying the molten metal material to form a solid metal matrix material; and removing the displacement from the solid metal matrix material.

14. The method of claim 11, wherein forming the at least one internal fluid passageway in the bit body of the earth-boring drill bit comprises:

pressing a powder mixture comprising a plurality of hard particles and particles of a metal matrix material to form a green body;

machining the green body to form the at least one internal fluid passageway and the at least one filter feature in the at least one internal fluid passageway; and sintering the green body to a desired final density.

15. The method of claim 11, wherein forming the at least one internal fluid passageway in the bit body of the earth-boring drill bit comprises:

pressing a powder mixture comprising a plurality of hard particles and particles of a metal matrix material to form a green body;

partially sintering the green body to form a brown body;

machining the brown body to form the at least one internal fluid passageway and the at least one filter feature in the at least one internal fluid passageway; and sintering the brown body to a desired final density.

16. A method of forming an earth-boring drill bit, the method comprising:

forming at least one internal fluid passageway in a bit body of an earth-boring drill bit; and forming at least one filter feature in the at least one internal fluid passageway configured to prevent at least some cuttings from flowing through the at least one internal fluid passageway, wherein forming the at least one filter feature in the at least one internal fluid passageway comprises:

forming a washer comprising at least one lateral member extending thereacross;

disposing the washer in the at least one internal fluid passageway;

inserting a nozzle at least partially within the at least one internal fluid passageway; and cooperatively configuring a surface of the bit body within the at least one internal fluid passageway and the nozzle to provide mechanical interference between the washer, the surface of the bit body within the at least one internal fluid passageway, and the nozzle to retain the washer in the at least one internal fluid passageway.

17. A method of forming an earth-boring drill bit, the method comprising:

forming at least one internal fluid passageway in a bit body of an earth-boring drill bit, wherein forming the at least one internal fluid passageway in the bit body of the earth-boring drill bit comprises:

forming a displacement having a shape corresponding to the at least one internal fluid passageway;

forming a longitudinally central portion of the displacement to have a width along a lateral axis thereof less than an average width of a longitudinal distal end portion of the displacement;

placing the displacement within a mold cavity having a shape corresponding to at least a portion of the bit body;

placing a plurality of hard particles within the mold cavity and around the displacement;

infiltrating the plurality of hard particles with a molten metal material;

solidifying the molten metal material to form a solid metal matrix material; and removing the displacement from the solid metal matrix material; and forming at least one filter feature in the at least one internal fluid passageway configured to prevent at least some cuttings from flowing through the at least one internal fluid passageway.

18. A method of forming an earth-boring drill bit, the method comprising:

forming at least one internal fluid passageway in a bit body of an earth-boring drill bit, wherein forming at least one internal fluid passageway in the bit body of the earth-boring drill bit comprises:

forming a green or brown bit body, by pressing a powder mixture comprising a plurality of hard particles and particles of a metal matrix material;

forming the at least one filter feature in the at least one internal fluid passageway by forming a longitudinally central portion of the at least one internal fluid passageway to have a width along a lateral axis thereof less than an average width of a longitudinal distal end portion of the at least one internal fluid passageway; and sintering the green or brown bit body to a desired final density; and forming at least one filter feature in the at least one internal fluid passageway configured to prevent at least some cuttings from flowing through the at least one internal fluid passageway.

* * * * *